US006868828B2

(12) United States Patent
Kondo

(10) Patent No.: US 6,868,828 B2
(45) Date of Patent: Mar. 22, 2005

(54) IDLE SPEED CONTROL APPARATUS IN THROTTLE BODY

(75) Inventor: Yasushi Kondo, Kawasaki (JP)

(73) Assignee: Keihin Corporation, Tokyo (JP)

( * ) Notice: Subject to any disclaimer, the term of this patent is extended or adjusted under 35 U.S.C. 154(b) by 1 day.

(21) Appl. No.: 10/615,267

(22) Filed: Jul. 8, 2003

(65) Prior Publication Data

US 2004/0084013 A1 May 6, 2004

(30) Foreign Application Priority Data

Nov. 5, 2002 (JP) ..... 2002-320723

(51) Int. Cl.[7] ..... F02D 9/10
(52) U.S. Cl. ..... 123/339.26; 123/336
(58) Field of Search ..... 123/339.26, 339.25, 123/339, 361, 339.21, 336

(56) References Cited

U.S. PATENT DOCUMENTS 4,494,502 A * 1/1985 Endo et al. ..... 123/198 F
4,779,480 A * 10/1988 Stocker ..... 74/513
5,651,343 A * 7/1997 Evans et al. ..... 123/339.26

FOREIGN PATENT DOCUMENTS

EP 0 628 713 A1 * 12/1994 ..... F02D/9/10

* cited by examiner

*Primary Examiner*—Hieu T. Vo
(74) *Attorney, Agent, or Firm*—Zito tlp; Joseph J. Zito; Kendal M. Sheets

(57) ABSTRACT

An idle speed control apparatus which improves freedom of selection in an opening degree characteristic of a throttle valve is structured such that an intake passage of a throttle body is opened and closed by a throttle valve, a cam lever is attached to one end of a rotatably supported link shaft, a link lever is attached to another end of the link shaft, a slider of a stepping motor is connected to the link lever, a cam portion of the cam lever is connected to a roller of the throttle valve lever, linear motion of the slider is transmitted to the link shaft via the link lever to rotationally displace the link shaft, rotation of the cam lever is transmitted to the throttle valve lever, and the throttle valve opens an idling opening degree corresponding to the rotation of the stepping motor.

4 Claims, 4 Drawing Sheets

PRIOR ART

IDLE SPEED CONTROL APPARATUS IN THROTTLE BODY

FIELD OF THE INVENTION

The present invention relates to a throttle body used in a fuel injection apparatus which increases a pressure of fuel within a fuel tank by a fuel pump and supplies the pressure increased fuel to an engine via a fuel injection valve, and more particularly to an idle speed control apparatus in a throttle body which controls a low opening degree area of a throttle valve controlling an opening area of an intake passage passing through the throttle body.

DESCRIPTION OF THE PRIOR ART

A conventional idle speed control apparatus in a throttle body is shown in FIG. 4.

Reference numeral 30 denotes a throttle body provided with an intake passage 31 extending through the inside thereof. A butterfly type throttle valve 33 controlling so as to open and close the intake passage 31 is attached to a throttle valve shaft 32 rotatably supported to the throttle body 30 across the intake passage 31.

Reference numeral 34 denotes a main driving lever fixed to the throttle valve shaft 32 protruding sideward from the throttle body 30. The main driving lever 34 is provided with a fork end lever portion 34A having an opposing gap S, and an adjusting lever portion 34C with which an adjusting screw 34B is screwed.

Accordingly, when the main driving lever 34 rotates, the throttle valve shaft 32 rotates in correspondence to this rotation, whereby the main driving lever 34 and the throttle valve 33 synchronously rotate.

In the present embodiment, the throttle valve 33 opens the intake passage 31 in accordance with the main driving lever 34 rotating counterclockwise, and the throttle valve 33 closes the intake passage 31 in accordance with the main driving lever 34 rotating clockwise.

Reference numeral 35 denotes a throttle lever rotatably loosely fitted to the throttle valve shaft 32. The throttle lever 35 is operated by a valve opening wire 36 and a valve closing wire 37 which are operated by a driver. When the valve opening wire 36 is pulled, the throttle lever 35 rotates counterclockwise in the drawing, and when the valve closing wire 37 is pulled, the throttle lever 35 rotated clockwise in the drawing.

Further, reference numeral 38 denotes a throttle valve return spring. One end of the throttle valve return spring 38 is engaged with the throttle lever 35, and another end thereof is engaged with a fixed portion such as the throttle body 30 or the like. The throttle lever 35 is energized clockwise by a spring force of the throttle valve return spring 38.

Further, a rod-shaped transmission lever 39 is provided in the throttle lever 35 so as to protrude, and this transmission lever 39 is arranged within the gap S of the fork end lever portion 34A in the main driving lever 34.

Reference numeral 40 denotes a stop screw controlling a rotational position of the throttle lever 35. A leading end of the stop screw 40 is arranged so as to be brought into contact with an arm portion 35A of the throttle lever 35.

Further, reference numeral 41 denotes a main driving lever spring for applying a clockwise turning force to the main driving lever 34. One end of the main driving lever spring 41 is engaged with the main driving lever 34, and another end thereof is engaged with the throttle lever 35. In accordance with this structure, one side fork end lever portion 34Aa is brought into contact with the transmission lever 39.

Reference numeral 42 denotes a link lever rotatably loosely fitted to the throttle valve shaft 32. A first arm 42A of the link lever 42 is arranged so as to oppose to a leading end of the adjusting screw 34B, and a second arm 42B is arranged so as to oppose to a leading end of a slider 43 in a stepping motor M.

In accordance with the conventional throttle body mentioned above, the throttle valve 33 is opened and closed in the following manner.

When the driver pulls the valve opening wire 36, the throttle lever 35 rotates counterclockwise against a spring force of the throttle valve return spring 38. This rotation is transmitted to the fork end lever portion 34Aa in one side of the main driving lever 34 from the transmission lever 39, and the main driving lever 34 thereby rotates counterclockwise.

Accordingly, the throttle valve 33 opens the intake passage 31 on the basis of the counterclockwise rotation of the main driving lever 34.

In this case, since the adjusting screw 34B screwed with the adjusting lever portion 34C of the main driving lever 34 is apart from the first arm 42A of the link lever 42 at the time when the main driving lever 34 rotates counterclockwise, no operating force is applied to the link lever 42.

On the other hand, when the driver pulls the valve closing wire 37, the throttle lever 35 rotates clockwise in cooperation with the spring force of the return spring 38.

Further, when the transmission lever 39 rotates clockwise in synchronization with the clockwise rotation of the throttle lever 35, the main driving lever 34 rotates clockwise in synchronization with the throttle lever 35 by the spring force of the main driving lever spring 41 so that one side fork end lever portion 34Aa follows the transmission lever 39, whereby the throttle valve 33 closes the intake passage 31.

In this case, an idle speed control of the throttle valve such as an idling speed control in correspondence to a water temperature of an engine and an engine ambient temperature, a first idling speed control at a time of starting the engine or the like is performed in the following manner.

The stepping motor M rotates on the basis of an output signal from an ECU, and this rotation is converted into a linear motion by the slider 43 so as to be output.

In this case, when the slider 43 is extended, the slider 43 presses the second arm 42B so as to rotate the link lever 42 counterclockwise. This rotation is transmitted to the adjusting screw 34B of the main driving lever 34 via the first arm 42A, and the main driving lever 34 thereby rotates counterclockwise in correspondence to the extending movement of the slider 43.

In accordance with the counterclockwise rotation of the main driving lever 34, the throttle valve 33 can open the intake passage 31 larger than a predetermined idling opening degree, thereby performing the idle speed control in which the throttle valve 33 is opened larger than the idling opening degree.

In this case, since the gap exists between the transmission lever 39 of the throttle lever 35 and another side fork lever portion 34Ab of the main driving lever 34 at the time when the main driving lever 34 rotates counterclockwise, the throttle lever 35 is not rotated.

In accordance with the conventional idle speed control apparatus in the throttle body, the following problems are generated.

First, an opening degree characteristic of the throttle valve 33 has small freedom in selection with respect to the movement of the slider 43 in the stepping motor M.

This is because the opening degree of the throttle valve 33 is determined only by the liner motion of the slider 43 and the rotational motion of the link lever 42.

Second, it is impossible to effectively improve a resolving power of the opening degree change in the throttle valve 33 with respect to the stroke movement of the slider 43 in the stepping motor M.

That is, in order to improve the resolving power mentioned above, it is necessary to increase a distance A–B between a contact point A of the slider 43 with the second arm 42B, and a center B of the throttle valve 33. In accordance with this structure, since a shape of the link lever 42 is large scaled and it is necessary to make a rigidity of the link lever 42 high, the structure is not practically preferable.

Third, it is hard to reduce an impact against the stepping motor M at the sudden closing time of the throttle valve when the throttle valve 33 is suddenly closed from a state opening at a high opening degree to the idling opening degree.

That is, at the sudden closing time of the throttle valve 33, the transmission lever 39 is brought into contact with the another side fork end lever portion 34Ab, thereby mechanically pressing the main driving lever 34 clockwise. The adjusting screw 34B of the main driving lever 34 exposed to the mechanical pressing force presses the first arm 42A of the link lever 42, whereby the second arm 42B presses the slider 43 in an impact manner.

Fourth, it is necessary to concentrically arrange three levers comprising the throttle lever 35, the main driving lever 34 and the link lever 42 in one end of the throttle valve shaft 32, and a protruding length of the throttle valve shaft 32 protruding to sideward from the throttle body 30 becomes longer than the structure provided only with the throttle lever 35.

Accordingly, it is necessary to retest the durability of the throttle valve shaft 32 and the bearing portion of the throttle body 30, and a new developing man hour is required.

SUMMARY OF THE INVENTION

An idle speed control apparatus in a throttle body in accordance with the present invention is made by taking the problems mentioned above into consideration, and an object of the present invention is to provide an idle speed control apparatus which can improve a freedom of selection in an opening degree characteristic of a throttle valve, improve a resolving power with respect to an opening degree change of the throttle valve, and reduce an impact against a stepping motor at the time of suddenly closing the throttle valve.

In accordance with a first aspect of the present invention, in order to achieve the object mentioned above, there is provided an idle speed control apparatus in a throttle body comprising:

a throttle body in which an intake passage is provided inside, the intake passage is opened and closed by a throttle valve attached to a rotatably supported throttle valve shaft, and a throttle valve lever operated by a driver is provided in an end portion of the throttle valve shaft;

a link apparatus in which a cam lever is attached to one end of a rotatably supported link shaft, and a link lever is attached to another end of the link shaft; and a stepping motor in which a rotation of a rotor is converted into a linear motion toward the outside by a slider so as to be output, wherein the linear motion of the slider of the stepping motor is transmitted as a rotational motion of the link shaft via the link lever, and a low opening degree rotational position of the throttle valve lever is controlled in correspondence to the rotation of the cam lever rotating in synchronization with the link shaft.

Further, in accordance with a second aspect of the present invention, there is provided an idle speed control apparatus in a throttle body as described in the first aspect, wherein an end portion of the slider is elastically clamped to the link lever by a nut and a collar pressed by a spring.

Further, in accordance with a third aspect of the present invention, there is provided an idle speed control apparatus in a throttle body as described in the first aspect, wherein the link lever is formed in an arc shape, an outer side surface of the collar formed in an arc shape is arranged so as to be brought into contact with an arc shaped inner side surface of the link lever, and the radius of the arc shape of the collar is made smaller than the radius of the arc shape of the link lever.

Further, in accordance with a fourth aspect of the present invention, there is provided an idle speed control apparatus in a throttle body as described in the first aspect, wherein two intake passages are provided in a side portion of the throttle body, two fuel injection valves clamped by a fuel distribution pipe and the throttle body are arranged in the throttle body toward the respective intake passages, and the stepping motor is arranged in a side space formed between two fuel injection valves.

In accordance with the first aspect of the present invention, the throttle valve controls so as to open and close the intake passage without relation to the link apparatus on the basis of the operation of the throttle lever by a driver.

On the other hand, when the slider linearly moves on the basis of the driving of the stepping motor, the link lever rotates in correspondence to the movement of the slider and the cam lever rotates. The rotation of the cam lever is transmitted to the throttle lever via the roller, whereby the idling opening degree of the throttle valve is automatically controlled to open.

Further, in accordance with the second aspect of the present invention, since the slider and the link lever are clamped by the nut and the collar pressed by the spring, it is possible to freely adjust the position of the slider with respect to the link lever by screwing the nut so as to change the nut position. Further, when the link lever presses the slider in an impact manner at the sudden close time of the throttle valve or the like, the impact force is absorbed by the elastic movement of the collar, so that no great load is applied to the stepping motor.

Further, in accordance with the third aspect of the present invention, since the outer surface of the collar and the inner surface of the link lever are brought into contact with each other in a similar manner to a point contact, it is possible to accurately convert the linear motion of the slider into the rotational motion of the link lever, and a friction on the contact surfaces is less generated, so that it is possible to improve the durability.

Further, in accordance with the fourth aspect of the present invention, since the stepping motor is arranged in the side space formed between the adjacent fuel injection valves, it is possible to well arrange the stepping motor having a comparatively large shape.

DESCRIPTION OF THE PREFERRED EMBODIMENT

A description will be given below of an embodiment of an idle speed control apparatus in a throttle body in accordance with the present invention with reference to FIGS. 1 to 3.

Figure 1:
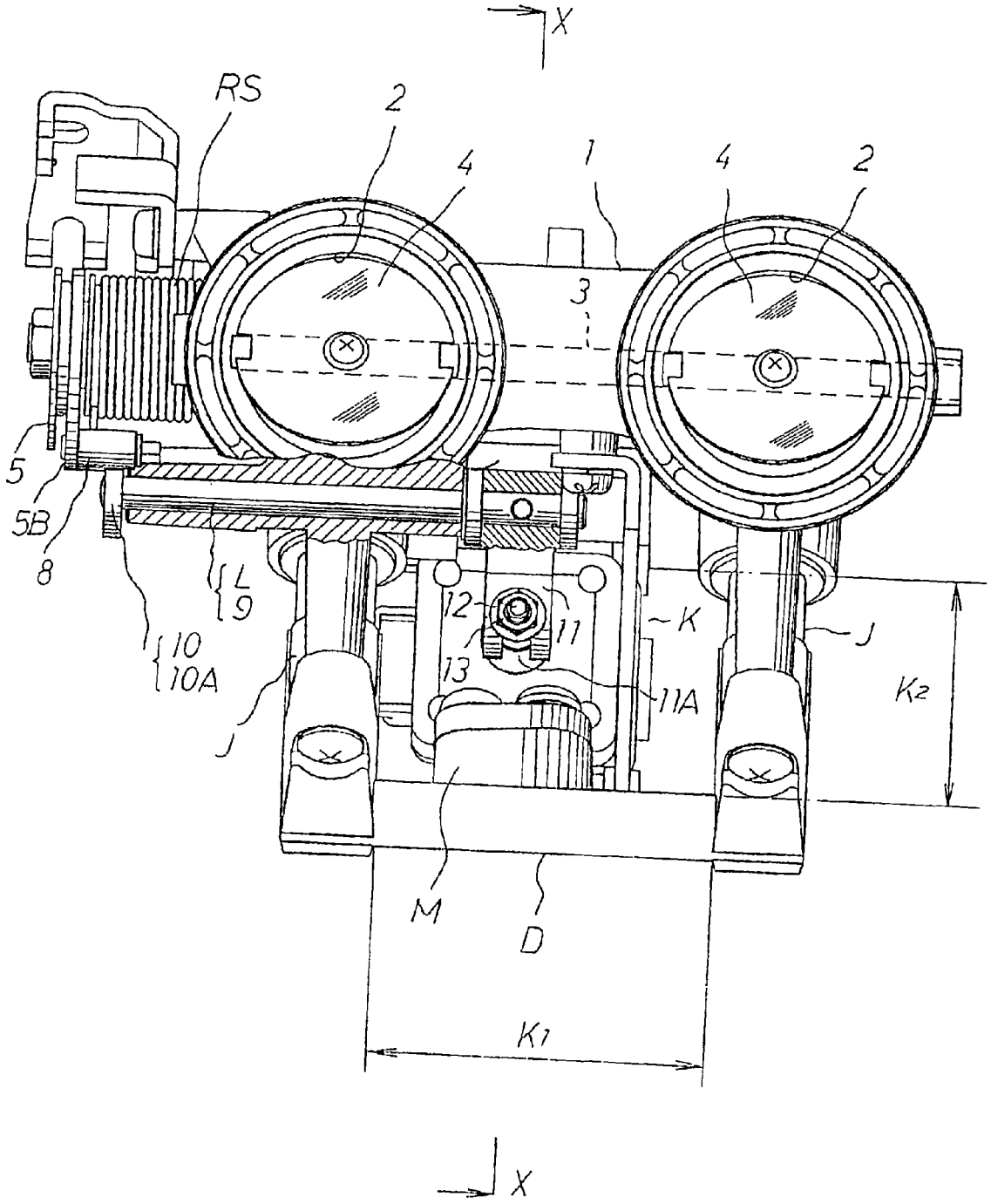
FIG. 1 is a front view which shows an embodiment of an idle speed control apparatus in a throttle body in accordance with the present invention.
Figure 2:
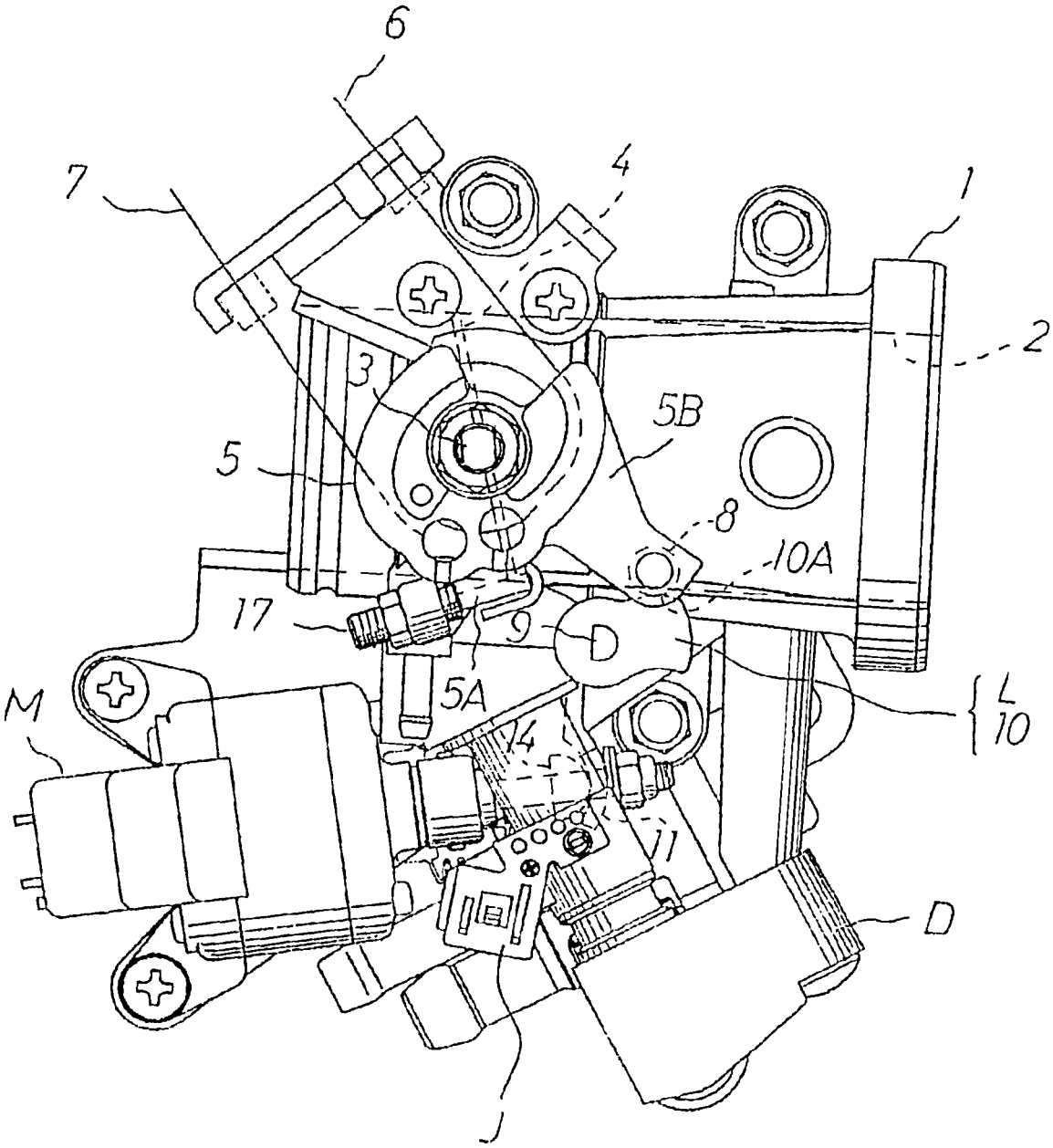
FIG. 2 is a left side view in FIG. 1.
Figure 3:
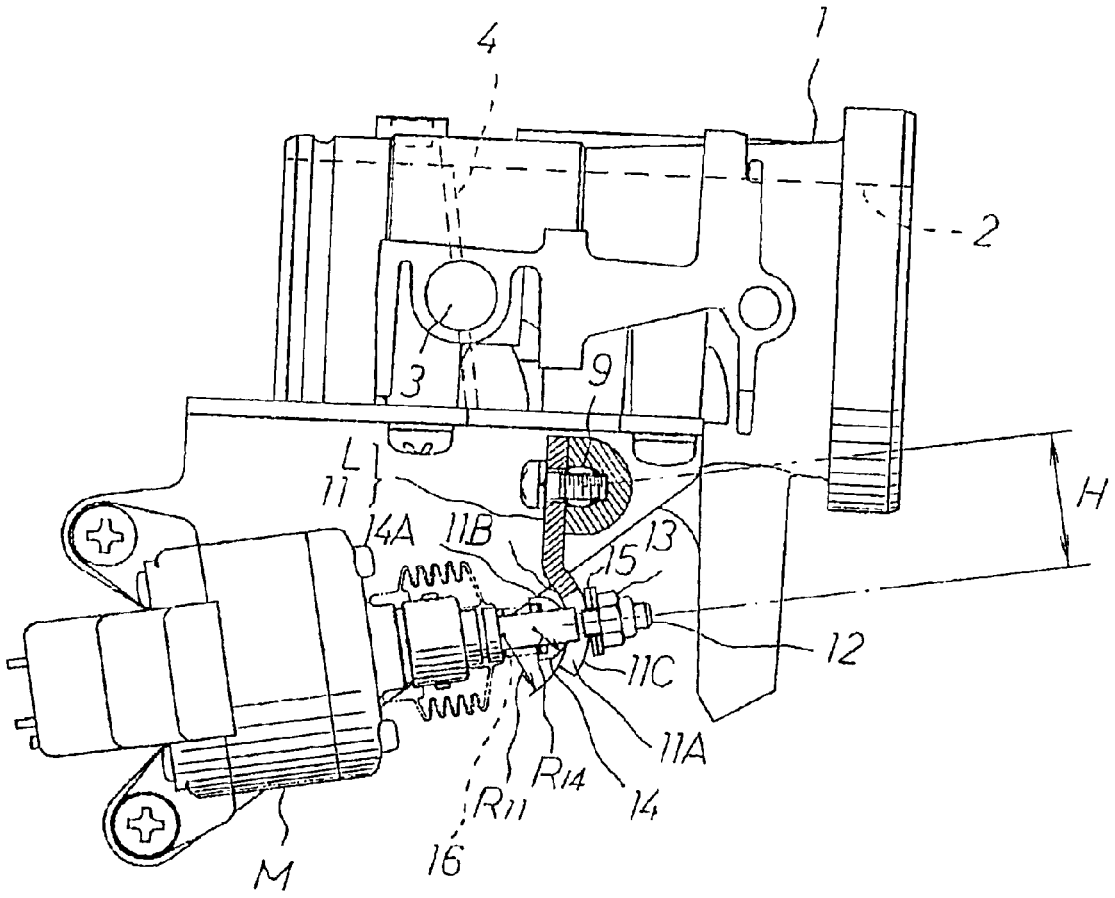
FIG. 3 is a vertical cross sectional view of a main portion along a line X—X in FIG. 1.
Figure 4:
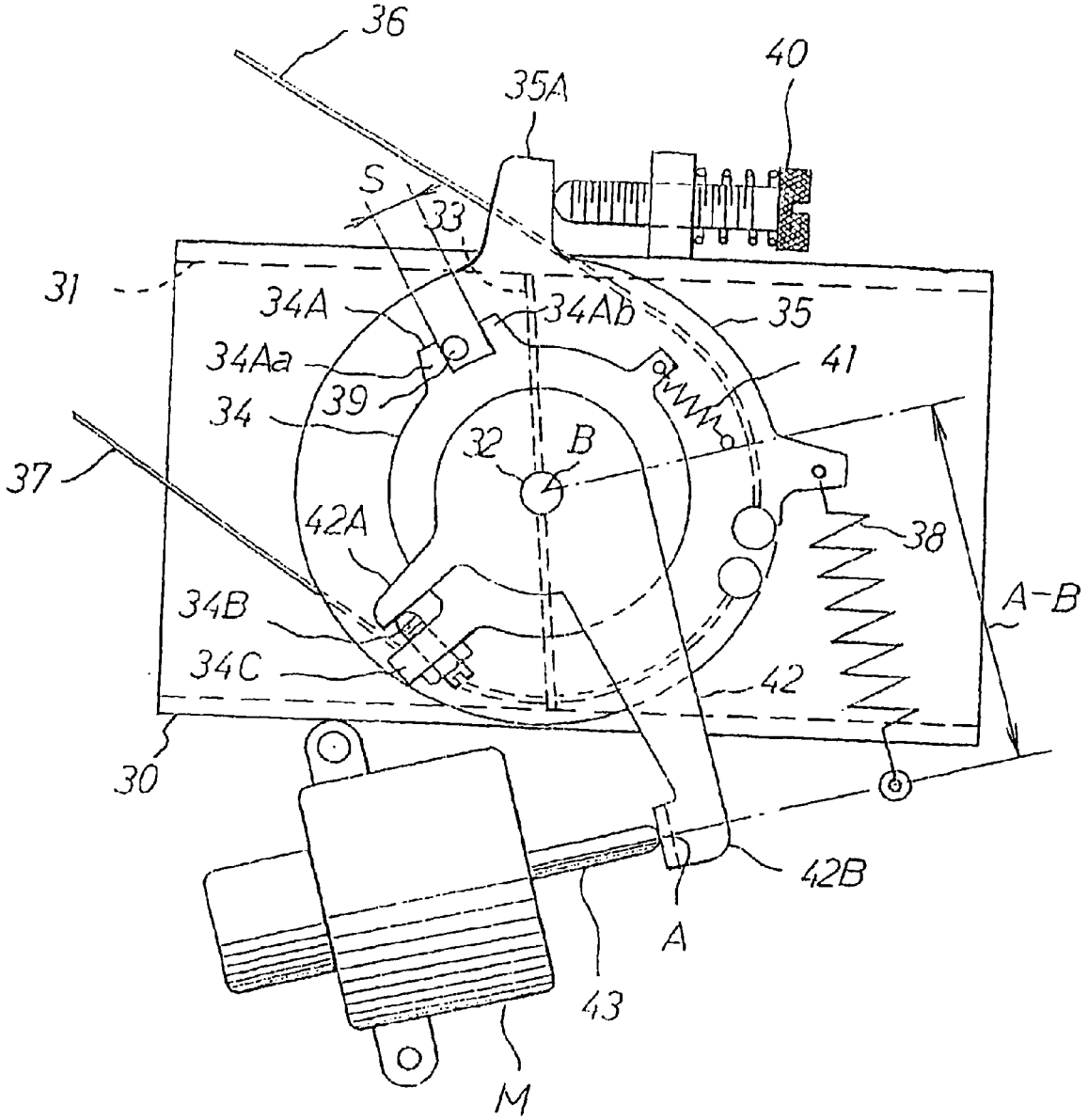
FIG. 4 is a side view which shows an idle speed control apparatus in a throttle body in accordance with the conventional art.

FIG. 1 is a front view partially including a vertical cross sectional view of the idle speed control apparatus, FIG. 2 is a left side view in FIG. 1, and FIG. 3 is a vertical cross sectional view of a main portion along a line X—X in FIG. 1.

Reference numeral 1 denotes a throttle body provided with an intake passage 2 extending sideward through the inside thereof. A throttle valve 4 is attached to a throttle valve shaft 3 rotatably supported to the throttle body 1 across the intake passage 2, and the intake passage 2 is controlled so as to be opened and closed by the rotation of this throttle valve 4.

In accordance with the present embodiment, two intake passages 2 are provided in a side portion of the single throttle body 1, and the throttle valves 4 and 4 opening and closing the respective intake passages 2 and 2 are attached to the single throttle valve shaft 3.

Reference numeral 5 denotes a throttle valve lever firmly fixed to a portion near the left end of the throttle valve shaft 3 protruding to the left side from the throttle body 1. A valve opening wire 6 and a valve closing wire 7 which are operated by a driver are engaged with the throttle valve lever 5. Further, a spring force in the throttle valve closing direction is applied to the throttle valve lever 5 by a throttle return spring Rs.

Further, a roller 8 is rotatably supported to an arm portion 5B of the throttle valve lever 5.

A link apparatus L is formed in the following manner.

Reference numeral 9 denotes a link shaft which is rotatably supported to the throttle body 1. A cam lever 10 is attached to the left end thereof, and a link lever 11 is attached to the right end thereof.

Further, a cam portion 10A of the cam lever 10 is arranged in a contact manner so as to face to the roller 8.

On the other hand, a base portion of the link lever 11 is screwed with and fixed to the link shaft 9, and a leading end portion of the link lever is formed in a fork shape and provided with a connection groove 11A.

Reference symbol M denotes a stepping motor attached to the throttle body 1. When an internal rotor (not shown) of the stepping motor M rotates, the rotation is output to the external as a linear motion by a slider 12.

The slider 12 is formed in a rod shape and is arranged to enter into the connection groove 11A of the link lever 11. The slider 12 is clamped to the link lever 11 by a nut 13 screwed with the leading end of the slider 12 and a collar 14 loosely fitted to the slider 12.

More particularly, the collar 14 is arranged in the slider 12 so as to be movably loosely fitted to the slider 12, and an outer surface 14A formed in a arc shape is arranged so as to face to an inner surface 11B of the link lever 11.

On the other hand, the nut 13 is screwed with the leading end portion of the slider 12 protruding from an outer surface 11C of the link lever 11 via a plain washer 15, and the slider 12 is connected to the link lever 11 by pressing an outer surface 14A of the collar 14 toward the inner surface 11B of the link lever 11 by a spring 16 compressedly provided in an outer periphery of the slider 12.

In this case, since the stepping motor M including the slider 12 is known, a detailed description thereof will be omitted.

A description will be given below of an operation of the idle speed control apparatus in the throttle body in accordance with the present invention having the structure mentioned above.

At a normal operation time, a stop screw 17 screwed with the throttle body 1 is brought into contact with the arm portion 5A of the throttle valve lever 5 so as to be positioned, whereby an idling opening degree of the throttle valve 4 is determined. Accordingly, an idling operation is performed.

Next, when the valve opening wire 6 is pulled by the driver, the throttle valve lever 5 rotates counterclockwise in FIG. 2 against the spring force of the throttle return spring Rs. Accordingly, the throttle valve 4 opens the intake passage 2 in correspondence to the counterclockwise rotation of the throttle valve lever 5.

At an idling operation time of the engine, the cam portion 10A of the cam lever 10 is not brought into contact with the roller 8, and the roller 8 is apart from the cam portion 10A at the time when the throttle valve lever 5 rotates counterclockwise.

Accordingly, at the normal idling operation of the engine and the opening operation of the throttle valve 4, the roller 8 and the cam portion 10A do not bring any troubles.

Next, when the valve closing wire 7 is pulled by the driver, the throttle valve lever 5 rotates clockwise in cooperation with the spring force of the throttle return spring Rs, whereby the throttle valve 4 closes the intake passage 2 in correspondence to the clockwise rotation of the throttle valve lever 5.

As mentioned above, the opening and closing motions of the throttle valve 4 including the engine idling operation are performed in the same manner as the conventional structure.

Next, a description will be given of an idle speed control in which an idling speed is increased in comparison with the normal idling operation.

For example, when a controlling pulse signal is input to a drive coil (not shown) of the stepping motor M in a state in which an engine temperature state or an engine ambient temperature state is low, a rotor (not shown) rotates in increments of one step angle every time when one pulse signal is input, and the rotor rotates in correspondence to the input signal.

Further, when the rotor rotates, the slider 12 is displaced in the axial direction of the slider 12. An extension of the slider 12 is transmitted to the link lever 11 via the collar 14, and the link lever 11 rotates counterclockwise in FIGS. 2 and 3.

Further, in accordance with the counterclockwise rotation of the link lever 11, the cam lever 10 attached to the left end of the link shaft 9 also rotates counterclockwise.

Further, the counterclockwise rotation of the cam lever 10 is transmitted to the roller 8 via the cam portion 1A, and makes the throttle valve lever 5 rotate counterclockwise against the spring force of the throttle valve return spring Rs.

Further, in accordance with the counterclockwise rotation of the throttle valve lever 5, the throttle valve 4 attached to the throttle valve shaft 3 also rotates counterclockwise.

Accordingly, the throttle valve 4 opens the intake passage 2 in correspondence to the extension of the slider 12 in the stepping motor M, and can increase the idle speed in correspondence to the opening degree.

In this case, in accordance with the idle speed control apparatus of the present invention, since the slider 12 of the stepping motor M is connected to the link lever 11 at the right end of the link shaft 9, and the cam lever 10 attached to the left end of the link shaft 9 is engaged with and arranged in the roller 8 stood from the throttle valve lever 5 via the cam portion 10A, it is possible to make the opening characteristic of the throttle valve 4 with respect to the linear movement of the slider 12 optimum in correspondence to the requirement of the engine by suitably selecting the shape of the cam portion 10A in the cam lever 10.

Further, even when applying the present apparatus to the different engine, the present apparatus can be applied to multiple kinds of engines by simply changing the cam portion 10A of the cam lever 10. Further, since the linear motion of the slider 12 is once converted into the rotational motion by the link lever 11, and next the throttle valve lever 5 is rotated by the cam portion 10A of the cam lever 10, it is possible to maintain the rotational displacement of the throttle lever 5 with respect to the change in the linear direction of the slider 12 extremely minute and with high precision, whereby it is possible to improve an increase of resolving power with respect to the throttle valve opening.

Further, in the structure mentioned above, since it is not necessary to make the distance H between the center of the link shaft 9, and the contact point between the link lever 11 and the slider 12, it is not necessary to specifically make the shape of the link lever 11 large, whereby it is possible to assemble a whole of the throttle body including the link apparatus L compact.

Further, in accordance with the apparatus of the present invention, at the time of the engine speed rapid reduction in which the throttle valve 4 is rapidly returned to the idling state from the open state, no strong impact force is applied to the stepping motor M, and it is possible to largely improve the durability of the stepping motor M.

That is, when the throttle valve lever 5 rapidly rotates clockwise at the engine speed rapid reduction time, the roller 8 is violently brought into contact with the cam portion 10A of the cam lever 10, however, the impact force is largely absorbed by the cam lever 10. However, in the case that the roller 8 comes into collision with the cam lever 10, clockwise turning force is applied to the link lever 11. In this case, when the clockwise turning force is largely applied to the link lever 11, the link lever 11 overcomes the spring force of the spring 16 so as to compress and displace the collar 14.

In accordance with the structure mentioned above, since no excessive impact force is applied to the slider 12 of the stepping motor M at the time when the throttle valve 4 is rapidly closed, no damage is applied to the stepping motor M.

Further, paying attention to the contact surface between the link lever 11 and the collar 14, in accordance with the present embodiment, since the radius R14 of the arc shaped outer surface 14A of the collar 14 is made smaller than the radius R11 of the arc shaped inner surface 11B of the link lever 11, the outer surface 14A of the collar 14 and the inner surface 11B of the link lever 11 are in contact with each other in a manner comparatively similar to a point contact. Accordingly, it is possible to smoothly transmit the force from the collar 14 to the link lever 11.

That is, the collar 14 and the link lever 11 is inhibited from being in complicated contact.

Further, in the structure in which two intake passages 2 are provided in the side portion of the single throttle body 1 as in the present embodiment, fuel injection valves J are respectively attached toward the intake passages 2 and 2, the leading ends of the fuel injection valves J are supported to the throttle body 1, and the rear ends thereof are supported to a fuel distribution pipe D provided with the fuel flow passage.

In accordance with the structure mentioned above, a side space K is formed between the throttle body 1 disposed between two intake passages 2 and 2, and two fuel injection valves J and J, and the fuel distribution pipe D, as shown in FIG. 1.

This side space K is shown by a dimension K1 between two fuel injection valves J and J, and a dimension K2 between the throttle body 1 and the fuel distribution pipe D.

Further, in the case that the stepping motor M provided with the slider 12 is arranged in the side space K, it is possible to arrange the stepping motor M having a comparatively large shape compactly in the throttle body 1.

Further, in accordance with the present invention, since the conventional throttle valve shaft 3 and the conventional throttle return spring Rs can be used as they are, and the arm portion 5B for attaching the roller 8 is only provided in the throttle valve lever 5, it is not necessary to change a length of the throttle valve shaft 3 protruding to the left side in FIG. 1 and a bearing length of the throttle valve shaft 3, whereby it is possible to simplify a durability confirmation test in connection with the throttle valve operation.

As mentioned above, in accordance with the idle speed control apparatus in the throttle body achieved by the present invention, since the link apparatus is structured such that the cam lever is attached to one end of the rotatably supported link shaft, the link lever is attached to another end thereof, the linear motion of the stepping motor is transmitted to the link lever, and the rotation of the cam lever is transmitted to the throttle valve lever, the opening characteristic of the throttle valve with respect to the linear motion of the slider in the stepping motor can be optimally applied to the requirement of the engine.

Further, it is possible to provide the throttle body which can be applied to multiple kinds of engines by changing the cam portion of the cam lever.

Further, since the linear motion of the slider is twice converted into the rotational motion by the link lever and the cam lever so as to be transmitted to the throttle valve lever, it is possible to largely improve the resolving power of the throttle valve opening degree with respect to the linear motion of the slider.

Further, since it is possible to inhibit the link lever from being large scaled in accordance with the structure mentioned above, it is possible to assemble the throttle body compact.

Further, since the end portion of the slider is elastically clamped to the link lever by the nut and the collar pressed by the spring, no excessive impact force in the closing direction is applied to the slider at the rapid closing time of the throttle valve, and it is possible to stably use the stepping motor for a long period.

Further, since the radius of the arc shape in the collar is made smaller than the radius of the arc shape in the link lever, it is possible to accurately transmit the movement of the collar accompanying with the movement of the slider to the link lever, and it is possible to inhibit the complication between link lever and the collar.

Further, since the stepping motor is arranged in the side space formed between two fuel injection valves, it is possible to arrange the stepping motor compact with respect to the throttle body.

What is claimed is:

1. An idle speed control apparatus in a throttle body comprising:

a throttle body 1 in which an intake passage 2 is, the intake passage is opened and closed by a throttle valve 4 attached to a rotatably supported throttle valve shaft 3, and a throttle valve lever 5 operated by a driver is provided in an end portion of the throttle valve shaft 3;

a link apparatus L in which a cam lever 10 is attached to one end of a rotatably supported link shaft 9, and a link lever 11 is attached to another end of the link shaft; and a stepping motor M in which a rotation of a rotor is converted into a linear motion toward the outside by a slider 12 so as to be output, wherein the linear motion of the slider 12 of the stepping motor is transmitted as a rotational motion of the link shaft 9 via the link lever 11, and a low opening degree rotational position of the throttle valve lever 5 is controlled in correspondence to the rotation of the cam lever 10 rotating in synchronization with the link shaft 9.

2. An idle speed control apparatus in a throttle body as claimed in claim 1, wherein an end portion of the slider is elastically clamped to the link lever 11 by a nut 13 and a collar 14 pressed by a spring 16.

3. An idle speed control apparatus in a throttle body as claimed in claim 1, wherein the link lever is formed in an arc shape, an outer side surface 14A of the collar 14 formed in an arc shape is arranged so as to be brought into contact with an arc shaped inner side surface 11B of the link lever 11, and a radius R14 of the arc shape of the collar 14 is made smaller than a radius R11 of the arc shape of the link lever 11.

4. An idle speed control apparatus in a throttle body as claimed in claim 1, wherein two intake passages 2, 2 are provided in a side portion of the throttle body, two fuel injection valves J clamped by a fuel distribution pipe D and the throttle body 1 are arranged in the throttle body toward the respective intake passages 2, 2, and the stepping motor is arranged in a side space K formed between two fuel injection valves J, J.

* * * * *